US007344223B2

(12) United States Patent
Ishikawa et al.

(10) Patent No.: US 7,344,223 B2
(45) Date of Patent: Mar. 18, 2008

(54) INK-JET RECOVERY DEVICE

(75) Inventors: Kan Ishikawa, Toyoake (JP); Takaichiro Umeda, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 11/589,593

(22) Filed: Oct. 30, 2006

(65) Prior Publication Data

US 2007/0097174 A1 May 3, 2007

(30) Foreign Application Priority Data

Oct. 31, 2005 (JP) ..... 2005-317048

(51) Int. Cl.
*B41J 2/165* (2006.01)

(52) U.S. Cl. ..... 347/33; 347/31; 347/32

(58) Field of Classification Search ..... 347/33, 347/29, 32, 31

See application file for complete search history.

(56) References Cited

U.S. PATENT DOCUMENTS 6,637,856 B2 * 10/2003 Nishi et al. ..... 347/29

FOREIGN PATENT DOCUMENTS

| | | |
|---|---|---|
| JP | 7125257 | 5/1995 |
| JP | 10166613 | 6/1998 |
| JP | 2005-041190 | 2/2005 |

* cited by examiner

*Primary Examiner*—Shih-Wen Hsieh
(74) *Attorney, Agent, or Firm*—Reed Smith LLP

(57) ABSTRACT

An ink-jet recovery device includes a rotation member, an ink absorbing member, a moving unit and a rotation unit. The rotation member is adapted to rotate on a predetermined rotation shaft. The ink absorbing member is arranged around the rotation shaft of the rotation member. The ink absorbing member can absorb ink from a tip of the nozzle member when abutted to the nozzle member. The nozzle member is provided in a recording head of an ink-jet recording apparatus and ejects ink toward a recording medium. The moving unit brings a part of the ink absorbing member into abutment with the nozzle member. The rotation unit rotates the rotation member on the rotation shaft to switch the part of the ink absorbing member to be brought into abutment with the nozzle member by the moving unit.

14 Claims, 10 Drawing Sheets

INK-JET RECOVERY DEVICE

CROSS-REFERENCE TO RELATED APPLICATIONS

This application claims the benefit of Japanese Patent Application No. 2005-317048 filed Oct. 31, 2005 in the Japan Patent Office, the disclosure of which is incorporated herein by reference,

BACKGROUND

This invention relates to an ink-jet recovery device that recovers ejection failure of a nozzle in a recording head of an ink-jet recording apparatus.

A conventional image recording apparatus includes an ink-jet recovery device that removes ink or foreign substance clogging a nozzle of a recording head.

This type of ink-jet recovery device is known to be provided with an ink absorbing member including a porous body. When a recovery operation is performed to recover ejection failure of the nozzle, the recording head is moved to a position (recovery position) where the ink absorbing member is to be located. The ink absorbing member is then lifted by a lifting device to be brought into contact with the nozzle of the recording head. Thereby, foreign substance clogging the nozzle is absorbed with ink to the ink absorbing member by capillary action.

SUMMARY

In such a conventional ink-jet recovery device, part of the ink absorbing member abutted to the nozzle in recovery operation is generally switched per color of ink ejected from the nozzle. This is because color mixture may be caused if the same part of the ink absorbing member is used to the nozzles for different colors of ink.

Particularly, the ink absorbing member is provided with the same number of ink absorbers as the ink colors. Each of the ink absorbers is brought into contact with the nozzle for one specific color.

The plurality of ink absorbers constituting the ink absorbing member are, however, arranged in line along an arrangement direction (linearly extending direction) of the nozzles for the plurality of colors in the recording head at the recovery position.

Accordingly, there is a problem that it is difficult to reduce the size of the conventional ink-jet recovery device since the ink absorbers are arranged in a linear fashion.

It would be desirable to achieve miniaturization of an ink-jet recovery device that recovers ejection failure of a nozzle in a recording head of an ink-jet recording apparatus.

It is desirable that an ink-jet recovery device of the present invention may include a rotation member, an ink absorbing member, a moving unit and a rotation unit. The rotation member is adapted to rotate on a predetermined rotation shaft. The ink absorbing member is arranged around the rotation shaft of the rotation member. The ink absorbing member can absorb ink from a tip of a nozzle member when abutted to the nozzle member. The nozzle member is provided in a recording head of an ink-jet recording apparatus and ejects ink toward a recording medium. The moving unit brings a part of the ink absorbing member into abutment with the nozzle member. The rotation unit rotates the rotation member on the rotation shaft to switch the part of the ink absorbing member to be brought into abutment with the nozzle member by the moving unit.

According to the ink-jet recovery device of the present invention, the same effect can be obtained as in a conventional ink-jet recovery device that the part of the ink absorbing member to be abutted to the nozzle member can be switched.

Moreover, in the present ink-jet recovery device, the ink absorbing member is not arranged in a linear fashion but arranged around the rotation shaft of the rotation member. Accordingly, reduction in size of the ink-jet recovery device can be achieved.

BRIEF DESCRIPTION OF THE DRAWINGS

The invention will now be described below, by way of example, with reference to the accompanying drawings, in which.

DETAILED DESCRIPTION OF THE PREFERRED EMBODIMENT

First Embodiment

Figure 1:
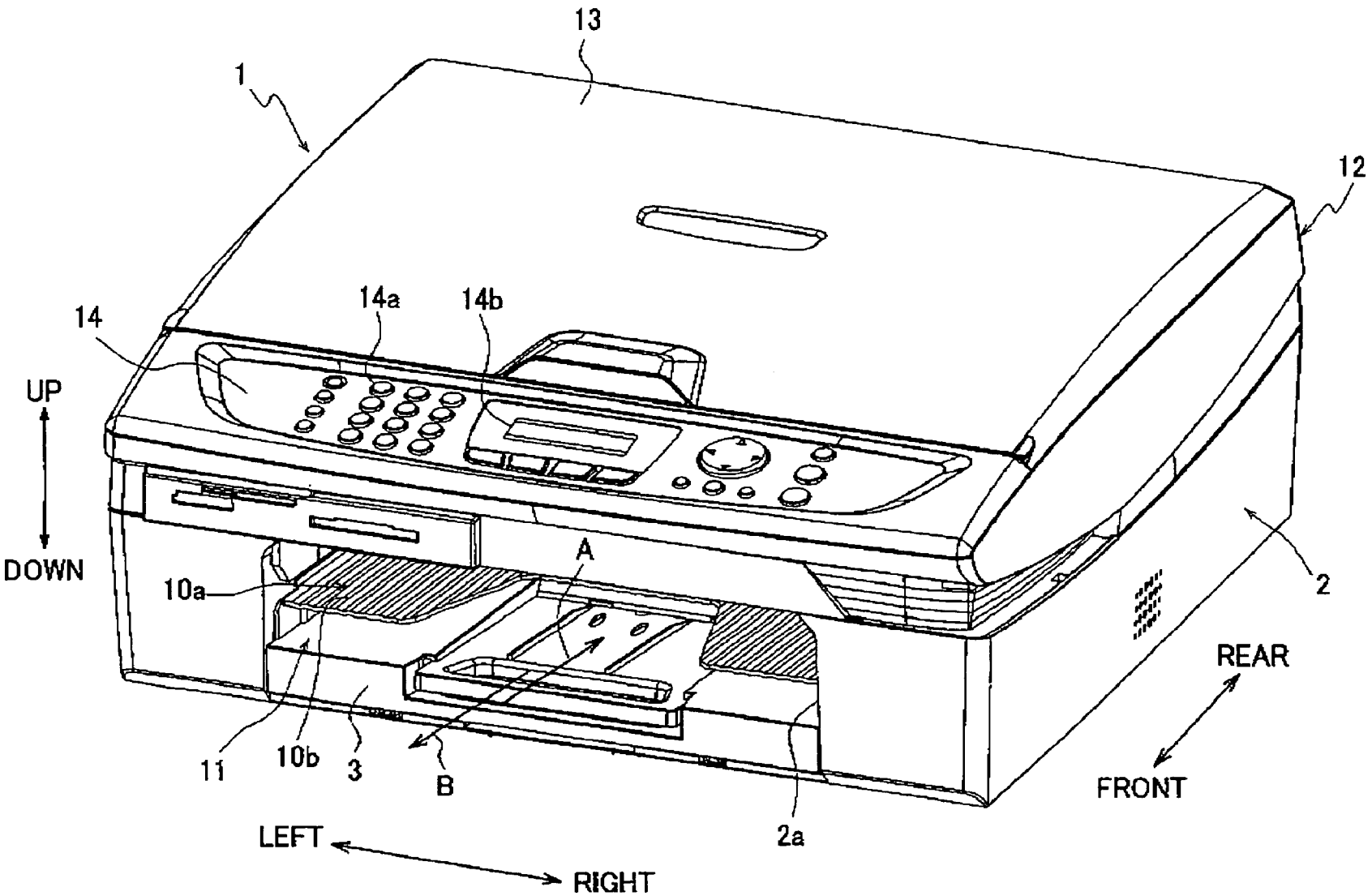
FIG. 1 is a perspective view of a multi function apparatus according to a first embodiment.
Figure 2:
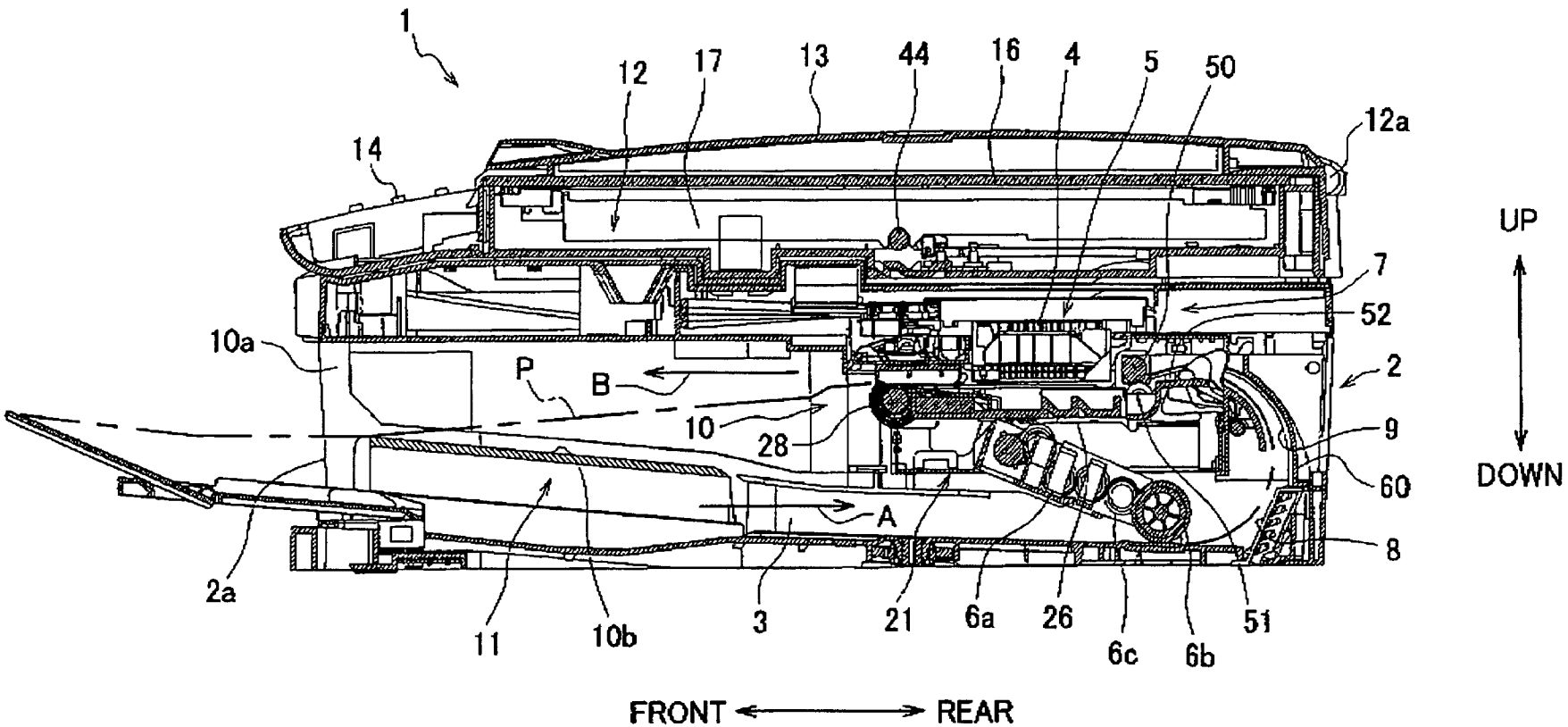
FIG. 2 is a cross sectional side view of the multi function apparatus according to the first embodiment.

A multi function apparatus 1 (MFD) of the present embodiment is provided with a printer function, a copying function, a scanner function and a facsimile function. As shown in FIGS. 1 and 2, an image reader 12 used for scanning and reading a document is provided above a housing 2.

The image reader 12 is designed to be opened and closed with respect to the housing 2 about a not shown pivot shank provided at a left end of the image reader 12. A cover 13 which covers the upper surface of the image reader 12 is turnably attached so as to be opened and closed with respect to the image reader 12 about a pivot shaft 12*a* (see FIG. 2) provided at a rear end of the cover 13.

A glass plate 16 is provided on the upper surface of the image reader 12. When the cover 13 is opened up, a document can be set on the glass plate 16 to be read. A contact image scanner (CIS) 17 for reading a document is provided below the glass plate 16. The contact image scanner 17 can reciprocate along a guide shaft 44 which extends in a direction orthogonal to the sheet surface of FIG. 2 drawing (right and left direction).

An operation panel 14 including operation buttons 14*a* for input operation and a liquid crystal display (LCD) 14*b* for displaying various information is provided at the front of the image reader 12.

A feeding unit 11 for feeding recording paper P is provided at the bottom of the housing 2. The feeding unit 11 includes a paper cassette 3 which can be attached to or detached from the housing 2 in a cross direction via an opening 2*a* which is formed at the front side of the housing 2. In the present embodiment, the paper cassette 3 is designed to store a plurality of recording paper P in A4, letter, legal, and postcard sizes in a stack (accumulated manner). The recording paper P is arranged such that its narrow sides (width) extend in a direction (main scanning direction or right and left direction) orthogonal to a paper feeding direction (sub-scanning direction, cross direction, or direction of an arrow A).

A tilted separator 8 for recording paper separation is disposed at the back (rear end) side of the paper cassette 3. The tilted separator 8 is formed into a convex curvature in a plan view so as to protrude at the middle and to be dented toward the right and left ends in a width direction (right and left direction) of the recording paper P. A saw-edged elastic separation pad is provided at a region corresponding to the middle in the width direction of the recording paper P. The separation pad abuts the front edge of the recording paper P to expedite separation.

Behind the feeding unit 11, a feed arm 6*a* for feeding the recording paper P from the paper cassette 3 is turnably attached so as to swing up and down on its anchor end. A rotational driving force from an LF (conveying) motor 131 (Bee FIG. 5) is transmitted to a feed roller 6*b* provided at a tip end of the arm 6*a* via a gear transmission mechanism 6*c* provided inside the feed arm 6*a*. The recording paper P stacked in the paper cassette 3 is separately conveyed sheet by sheet by the feed roller 6*b* and the aforementioned elastic separation pad of the tilted separator 8. The recording paper P which is separated to advance along the paper feeding direction (direction of the arrow A) is fed to a recording unit 7 via a paper feeding path 9 which includes a U-turn path formed in a space between a first feeding guide 60 and a second feeding guide 52. The recording unit 7 is provided above the paper cassette 3.

Figure 3:
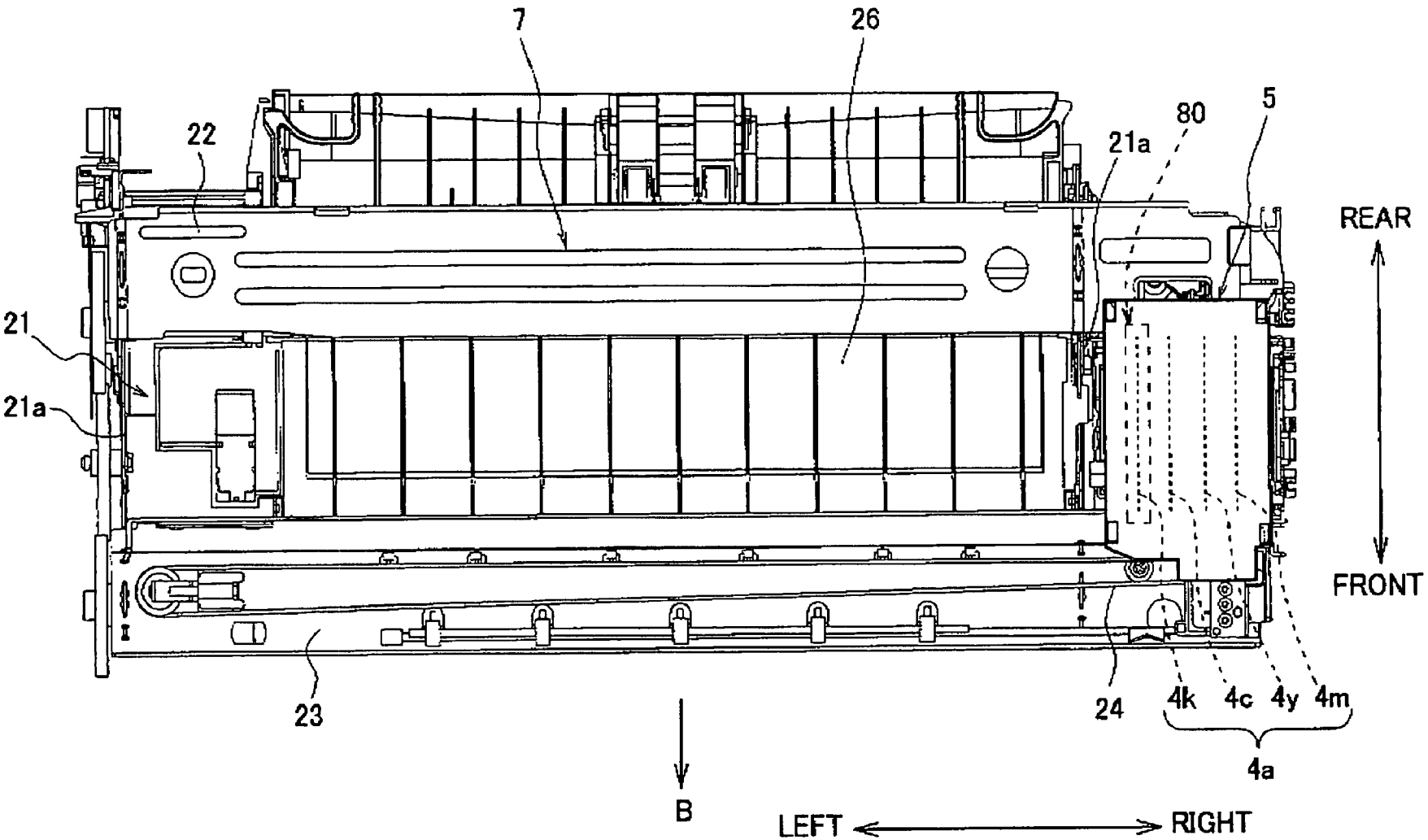
FIG. 3 is a plan view of the multi function apparatus without an image reader.

FIG. 3 is a plan view showing the multi function apparatus 1 without the image reader 12.

As seen from FIG. 3, the recording unit 7 is provided between a main frame 21 formed into a box opened upward, and first and second plate-like guide members 22 and 23 which are supported by a pair of right and left side boards 21*a* of the main frame 21 and extend in right and left direction (main scanning direction). The recording unit 7 includes an ink-jet recording head 4 (see FIGS. 2 and 4) which ejects ink from the bottom side to record an image onto the recording paper P, and a carriage 5 which mounts the recording head 4 thereon.

The carriage 5 is slidably supported between the first guide member 22 located upstream and the second guide member 23 located downstream in a discharge direction (direction of an arrow B). The carriage 5 is designed to reciprocate in right and left direction. In order to reciprocate the carriage 5, a timing belt 24 makes a loop on the upper side of the second guide member 23 in a manner to extend in the main scanning direction (right and left direction). A CR (carriage) motor 132 (see FIG. 5) which drives the timing belt 24 is fixed to the down side of the second guide member 23.

A flat platen 26 is provided below the recording head 4 of the carriage 5 in the recording unit 7. The flat platen 26 faces the recording head 4 and extends in right and left direction. The platen 26 is fixed to the main frame 21 between the guide members 22 and 23.

Referring to FIG. 2, a driving roller 50 and a nip roller 51 are provided on the upstream side in the discharge direction (direction of the arrow B) of the platen 26. The driving roller 50 is a conveying (resist) roller which conveys the recording paper P to the under side of the recording head 4. The nip roller 51 is biased to the driving roller 50 side to face the driving roller 50. A discharge roller 28 and a spur roller (not shown) are provided on the downstream side of the discharge direction (direction of the arrow B) of the platen 26. The discharge roller 28 is driven to convey the recording paper P which has passed the recording unit 7 to the discharge unit 10 along the discharge direction (direction of the arrow B). The spur roller is biased to the discharge roller 28 side to face the discharge roller 28.

The discharge unit 10 is disposed above the feeding unit 11. The recording paper P after recorded in the recording unit 7 is discharged to the discharge unit 10 with its recording surface upward. A discharge hole 10*a*, together with the opening 2*a*, opens toward the front of the housing 2. The recording paper P discharged along the discharge direction (direction of the arrow B) from the discharge unit 10 is accumulated and stored on the discharge tray 10*b* located inside the opening 2*a*.

A not shown ink storage is provided on the right end at the front of the housing 2 below the image reader 12. Four ink cartridges are provided in the ink storage, which respectively store black (Bk) ink, cyan (C) ink, magenta (M) ink, and yellow (Y) ink for full color recording. The respective ink cartridges can be attached to and detached from the ink storage when the image reader 12 is opened upward. The respective ink cartridges are connected to the recording head 4 via four flexible ink supply tubes. Ink stored in the respective ink cartridges is supplied to the recording head 4 via the ink supply tubes.

Referring to FIG. 3, the recording head 4 is provided with a nozzle member 4*a* which ejects ink toward the recording paper P. The nozzle member 4*a* includes a plurality of (four in the present embodiment) nozzle rows 4*k*, 4*c*, 4*y* and 4*m*. Each of the nozzle rows 4*k*, 4*c*, 4*y* and 4*m* is provided with a plurality of nozzles arranged along a conveying direction (discharge direction or sub-scanning direction) of the recording paper P.

Particularly, the nozzle rows 4*k*, 4*c*, 4*y* and 4*m* are disposed from left to right in this order and respectively eject one of the four colors of ink (i.e., black (Bk) ink, cyan (C) ink, yellow (Y) ink, and magenta (M) ink) for full color recording. Each of the nozzle rows 4*k*, 4*c*, 4*y* and 4*m* is arranged along the conveying direction of the recording paper P and composed of the nozzles which eject the same color of ink.

A maintenance mechanism 80 is provided below the right end in a traveling path of the carriage 6. The nozzle rows 4*k*, 4*c*, 4*y* and 4*m* and the maintenance unit 80 are provided on the down side of the recording head 4, and thus, in FIG. 3, they are shown in dotted lines.

Figure 4B:
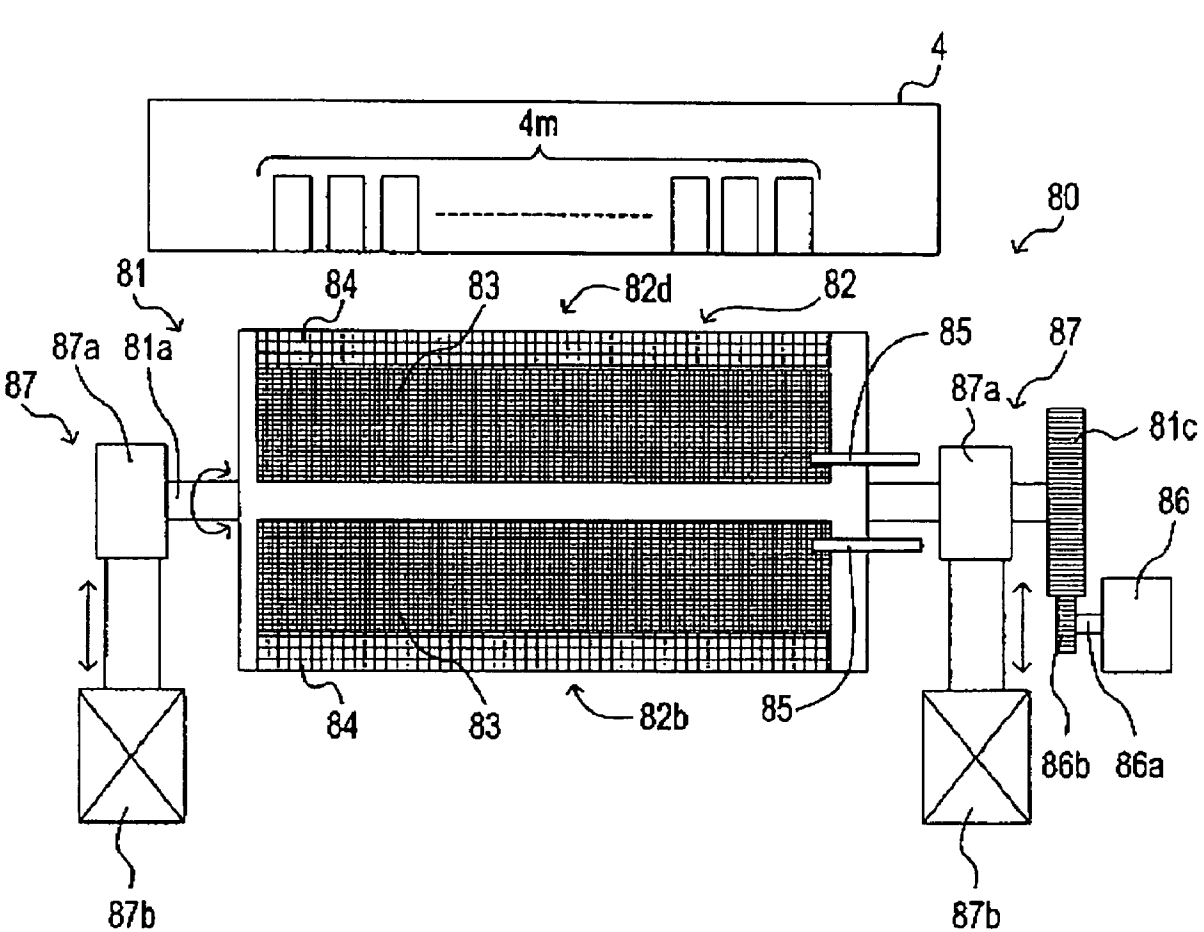
FIGS. 4A and 4B are explanatory views illustrating an internal structure of a maintenance mechanism.
Figure 4A:
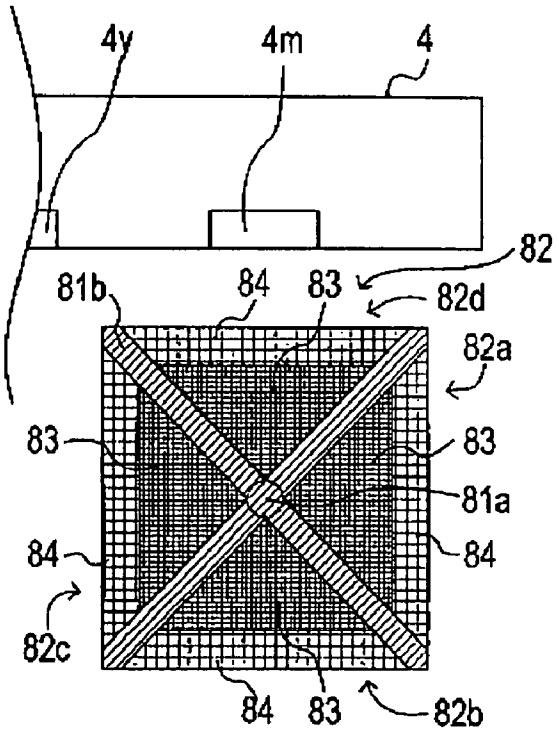

Next, a structure of the maintenance mechanism 80 is explained by way of FIGS. 4A and 4B.

FIG. 4A shows the maintenance mechanism 80 viewed from the front side of the multi function apparatus 1. FIG. 4B shows the maintenance mechanism 80 viewed from the left or right side of the multi function apparatus 1.

The maintenance mechanism 80 recovers ejection failure of the nozzle of the recording head 4 by capillary action. As shown in FIGS. 3, 4A and 4B, the maintenance mechanism 80 includes a rotation member 81, an ink absorbing member 82, a rotation motor 86, a lift 87, and a position sensor 88 (see FIG. 5).

The rotation member 81 is formed into a nearly longitudinal shape. The rotation member 81 is arranged such that its rotation shaft 81*a* is parallel to the conveying direction (arrangement direction of the nozzles).

The ink absorbing member 82 includes a plurality of (four in the present embodiment) ink absorbers 82*a* to 82*d* separately arranged around the rotation shaft 81*a* of the rotation member 81 per predetermined angle (90 degrees in the present embodiment) via a partition wall 81*b*. Each of the ink absorbers 82*a* to 82*d* is designed to abut one of the nozzle rows 4*k*, 4*c*, 4*y* and 4*m* in the recording head 4 to absorb ink from tips of the nozzles in the abutted nozzle row 4*k*, 4*c*, 4*y*, 4*m*.

The rotation motor 86 rotates the rotation member 81 on the rotation shaft 81*a*. The lift 87 raises and lowers the rotation member 81 (and the ink absorbers 82*a* to 82*d*). The position sensor 88 detects a reference position of the rotation member 81.

Each of the ink absorbers 82*a* to 82*d* is composed of an inner porous body 83 provided on the inward side (rotation shaft 81*a* side) and an outer porous body 84 provided on the outward side of the inner porous body 83.

The outer porous body 84 and the inner porous body 83 are made of plastic (e.g., polypropylene). The outer porous body 84 has a plurality of fine holes smaller than the diameter of each nozzle in the nozzle rows 4*k*, 4*c*, 4*y* and 4*m*. The inner porous body 83 has a plurality of fine holes smaller than the holes of the outer porous body 84.

Accordingly, when the ink absorber 82*a* to 82*d* is brought into contact with the nozzles in the corresponding nozzle row 4*k*, 4*c*, 4*y*, 4*m*, ink or foreign substance clogging the nozzle is absorbed into the ink absorber 82*a* to 82*d* which is in contact with the nozzles.

An ink discharge opening 85 is connected to the inner porous body 83 of the respective ink absorbers 82*a* to 82*d*. Ink absorbed into the ink absorbers 82*a* to 82*d* is carried by its own weight to an ink collector (not shown) that collects used ink via the ink discharge opening 85.

A gear 86*b* that rotates the rotation member 81 is attached to an output shaft 86*a* of the rotation motor 86. The gear 86*b* is engaged with a gear 81*c* which is connected to the rotation shaft 81*a* of the rotation member 81.

Accordingly, when the rotation motor 86 is driven, the gears 86*b* and 81*c* are rotated so that the rotation member 81 is rotated on the rotation shaft 81*a*.

The lift 87 is provided on each end side of the rotation shaft 81 (see FIG. 4B). The lift 87 includes a support member 87*a* that rotatably supports the rotation member 81 around the rotation shaft 81*a* and an actuator (electromagnetic solenoid in the present embodiment) 87*b* that is connected to the support member 87*a* to raise and lower the support member 87*a* (and the rotation member 81). The electromagnetic solenoid 87*b* expands and contracts by being electrically controlled by a later explained control processor 70, and raises and lowers the rotation member 81.

The position sensor 88 includes a light interceptor provided around the rotation shaft 81*a* of the rotation member 81, a light emitter and a light receiver.

The light interceptor has a disc-like shape. The light interceptor includes a convex portion which is integrally formed and protrudes radially outward.

The light emitter and the light receiver together composes a light sensor. The light emitter and the light receiver are arranged to face each other on the opposite sides of the convex portion of the light interceptor. Thereby, the convex portion of the light interceptor passes between the light emitter and the light receiver when the rotation member 81 is rotated.

The position sensor 88 is designed such that the convex portion blocks off light from the light emitter to the light receiver only when the ink absorber 82*d* is in a position facing upward as shown in FIG. 4A. In this manner, the position sensor 88 detects whether the rotation member 81 is in the reference position (position where the ink absorber 82*d* faces upward in the present embodiment).

Hereinafter, a structure of the control processor 70 of the multi function apparatus 1 is explained by way of FIG. 5.

Figure 5:
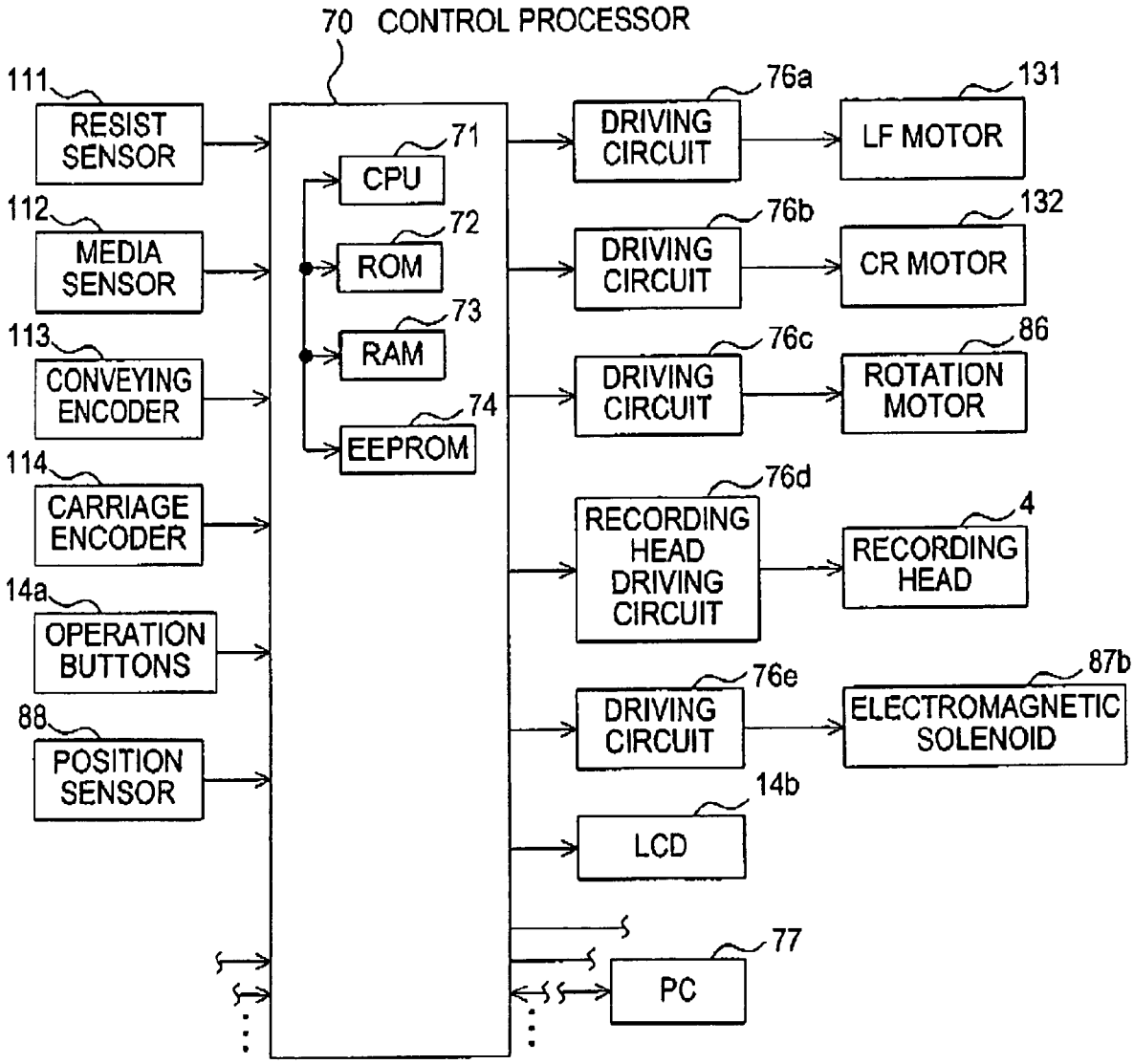
FIG. 5 is a block diagram showing a schematic structure of a control processor.

As shown in FIG. 5, the control processor 70 mainly includes a microcomputer constituted of a CPU 71, a ROM 72, a RAM 73, and an EEPROM 74. A resist sensor 111 that detects the position of the fed recording paper P, a media sensor 112 that detects front and rear ends and ends in a width direction of the recording paper P, a conveying encoder 113 that detects rotation amount of the driving roller 50, a carriage encoder 114 that detects travel distance of the carriage 5, the operation buttons 14*a*, the liquid crystal display 14*b*, and the position sensor 88 are connected to the control processor 70.

Also connected to the control processor 70 are a driving circuit 76*a* that drives the LF motor 131, a driving circuit 76*b* that drives the CR motor 132, a driving circuit 76*c* that drives the aforementioned rotation motor 86, a driving circuit 76*d* that drives the recording head 4, and a driving circuit 76*e* that drives the electromagnetic solenoid 87*b*. In the present embodiment, a personal computer 77 (PC 77) can be also connected to the control processor 70.

The control processor 70 (particularly, CPU 71) performs image forming onto the recording paper P as follows. The control processor 70 executes a paper end detection process for detecting positions of the ends of the recording paper P, upon receipt of recording directives to record onto the recording paper P from the PC 77 or other functioning blocks like copying and facsimile functioning portions in the multi function apparatus 1. Then, the control processor 70 performs a recording process in which an image is formed onto the recording paper P based on results of the paper end detection process. If recording onto the next recording paper P is necessary, the control processor 70 again performs the paper end detection process and the recording process. If recording onto the next recording paper P is not necessary, the process is ended.

Since known techniques are applied to the paper end detection and the recording process, detailed explanation on the same is omitted.

The control processor 70 also performs a recovery process for absorbing ink or foreign substance clogging the nozzles in the respective nozzle rows 4*k*, 4*c*, 4*y* and 4*m* which correspond to the color(s) specified by the recovery directives, upon receipt of recovery directives. The recovery directives are given from the user via the PC 77 or the operation buttons 14*a*. The recovery directives may be given on regular basis so that ink is absorbed from the nozzles in all the nozzle rows 4*k*, 4*c*, 4*y* and 4*m* at regular intervals. In this case, for example, ink is absorbed in this order of color: M, Y, C, Bk.

Figure 6:
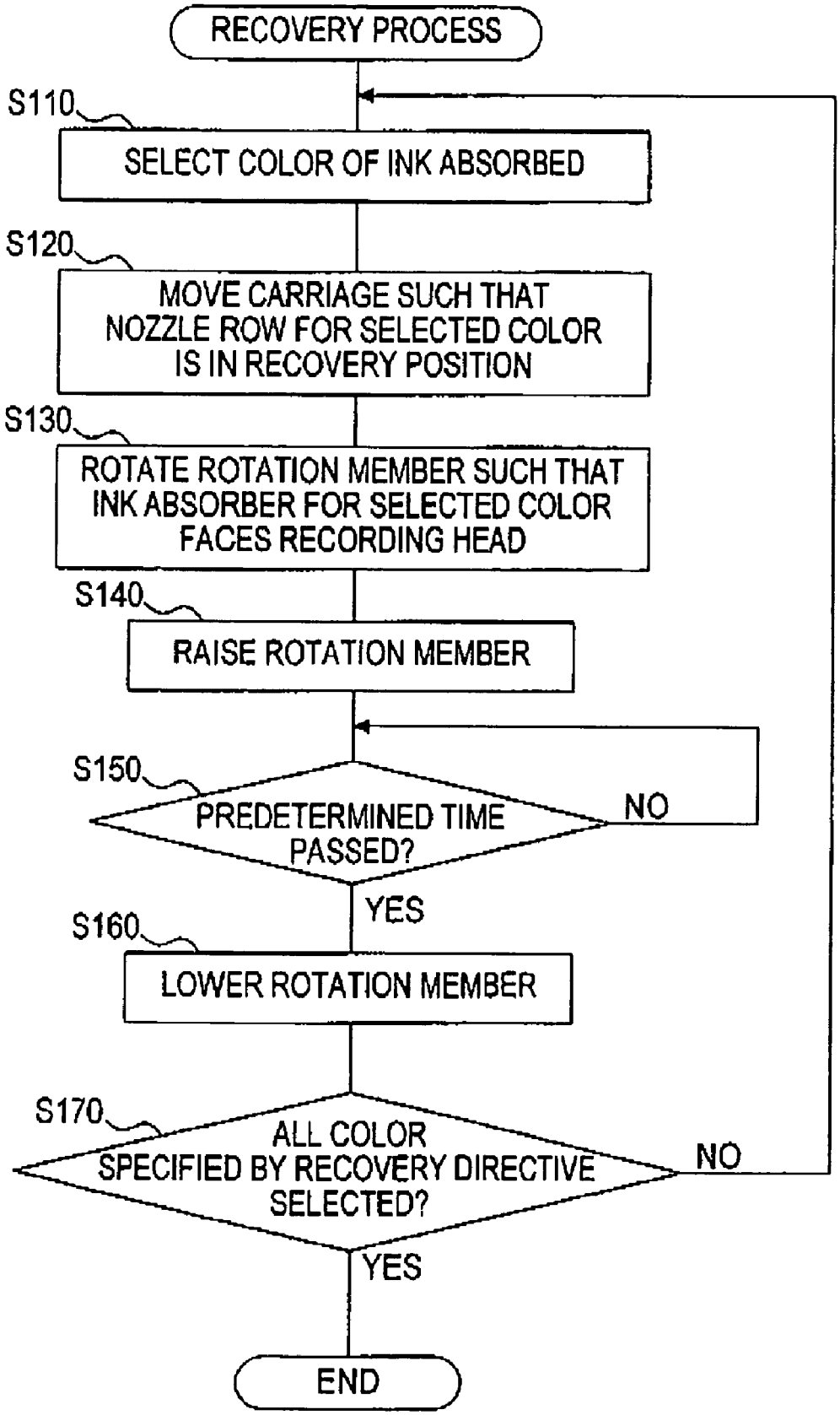
FIG. 6 is a flowchart illustrating a recovery process executed in the control processor according to the first embodiment.

Hereinafter, the recovery process executed by the control processor 70 is explained in detail by way of FIG. 6 and FIGS. 7A to 7F. FIG. 6 is a flowchart illustrating the recovery process in the present embodiment. FIGS. 7A to 7F are explanatory views partially illustrating steps in the recovery process according to the present embodiment.

In the recovery process, one of the color(s) specified by the present recovery directives is selected in S110.

Next in S120, the CR motor 132 is driven to move the carriage 5 such that one of the nozzle rows 4*k*, 4*c*, 4*y* and 4*m* corresponding to the color selected in S110 is moved to a predetermined position (hereinafter, referred to as a recovery position) to face the maintenance mechanism 80 (more particularly, the rotation shaft 81*a* of the rotation member 81).

In S130, the rotation motor 86 is driven to rotate the rotation member 81 such that the one of the ink absorbers 82*a* to 82*d* corresponding to the color selected in S110 faces the recording head 4 (i.e., faces the one of the nozzle rows 4*k*, 4*c*, 4*y* and 4*m* located at the recovery position).

In S130 of the present embodiment, if the color selected in S110 is black (Bk), the rotation member 81 is rotated such that the ink absorber 82*a* faces the recording head 4. If the color selected in S110 is cyan (C), the rotation member 81 is rotated such that the ink absorber 82*b* faces the recording head 4. If the color selected in S110 is yellow (Y), the rotation member 81 is rotated such that the ink absorber 82*c* faces the recording head 4. If the color selected in S110 is magenta (M), the rotation member 81 is rotated such that the ink absorber 82*d* faces the recording head 4.

If the one of the ink absorbers 82*a* to 82*d* corresponding to the color selected in S110 already faces the recording head 4, the rotation motor 86 is not driven and the process moves to S140.

Subsequently in S140, the electromagnetic solenoid 87*b* is driven to raise the rotation member 81 such that one of the ink absorbers 82*a* to 82*d* facing the recording head 4 is brought into contact with the nozzles in the one of the nozzle rows 4*k*, 4*c*, 4*y* and 4*m* located at the recovery position. As a result, ink or foreign substance clogging the nozzles in contact to the one of the ink absorbers 82*a* to 82*d* is absorbed due to capillary action.

In S150, it is determined whether a predetermined time has passed since the step of S140 is completed. If it is determined that the predetermined time has passed (S150: YES), the process moves to S160.

In S160, the electromagnetic solenoid 87*b* is driven to lower the rotation member 81 (to the previously located position).

Next in S170, it is determined whether all the color(s) specified by the present recovery directives are selected in S110.

If it is determined that not all the colors are selected in S110 (S170: NO), the process returns to S110. The color other than already selected is selected in S110. Here, if the present recovery process is not the process triggered by the operation of the user but the process performed at regular intervals, the steps from S110 to S160 are repeated until the recovery process is performed to the nozzles in all the nozzle rows 4*k*, 4*c*, 4*y* and 4*m*. On the other hand, if it is determined that all the colors are selected in S110 (S170: YES), the recovery process is ended.

As note above, in the multi function apparatus 1 of the first embodiment, when the recovery process is performed, one (e.g., magenta) of the color(s) specified by the recovery directive is firstly selected (S110). Then, the carriage 5 is moved such that the nozzle row (e.g., 4*m*) corresponding to the selected color comes to the recovery position (S120).

Figure 7A:
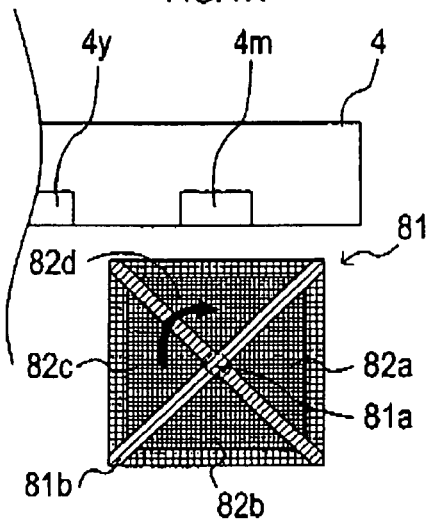
FIGS. 7A to 7F are explanatory views illustrating operation of the recovery process by the control processor.

Subsequently, as shown in FIG. 7A, the rotation member 81 is rotated such that the ink absorber 82*d* and the nozzle row 4*m* face each other (S130) when the selected color is magenta. The rotation member 81 is raised, as shown in FIG. 7B, so that the ink absorber 82*d* and the nozzle row 4*m* are in contact with each other (S140).

After the predetermined time has passed (S150 YES), the rotation member 81 is returned to the previously located position (S160). If not all the color(s) specified by the recovery directive are selected (S170: NO), another color specified by the recovery directive (e.g., yellow) is selected and the carriage 5 is moved such that the nozzle row (e.g., 4*y*) corresponding to the selected color comes to the recovery position. Next, as shown in FIG. 7C, the rotation member 81 is rotated so that the ink absorber 82*c* and the nozzle row 4*y* face each other when the selected color is yellow. Then, as shown in FIG. 7D, the rotation member 81 is raised so that the ink absorber 82*c* abuts the nozzles in the nozzle row 4*y*. After the predetermined time has passed, the rotation member 81 is returned to the previously located position.

Figure 7B:
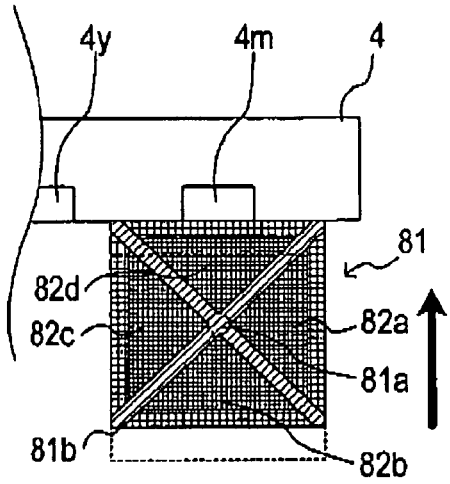
Figure 7C:
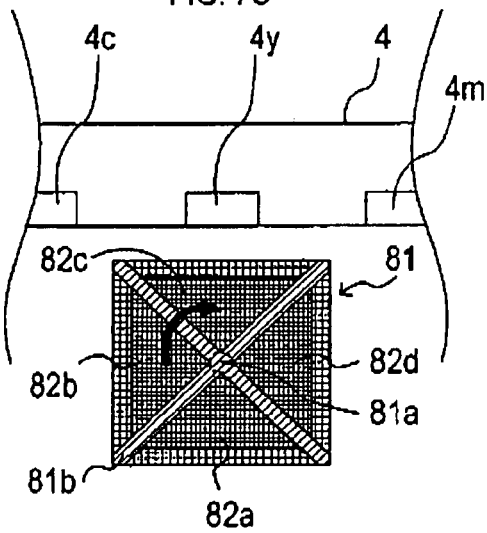
Figure 7D:
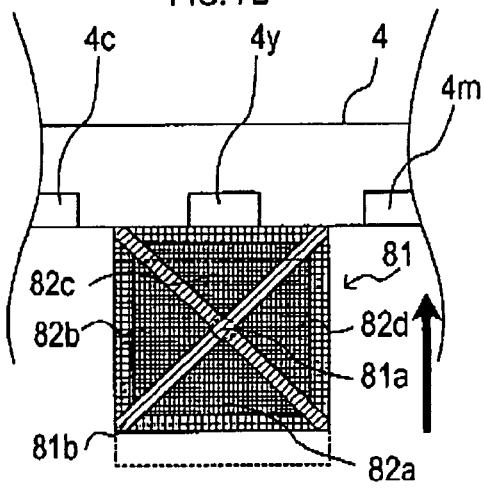
Figure 7E:
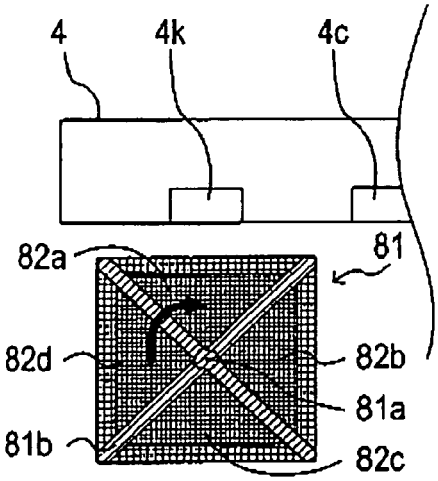
Figure 7F:
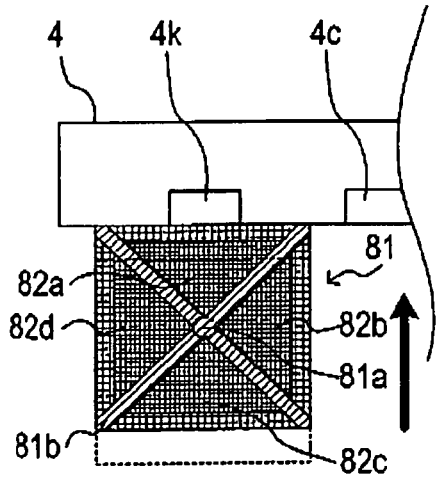

Hereinafter, until all the color(s) specified by the recovery directive are selected, the steps of S110 to S160 are repeated (FIGS. 7B and 7F).

According to the multi function apparatus 1 of the present embodiment, the same function as before can be achieved using one of the ink absorbers 82*a* to 82*d* corresponding to each color. Since there is no necessity to arrange the ink absorbers 82*a* to 82*d* in a line, miniaturization of the maintenance mechanism 80 (and the multi function apparatus 1) can be achieved.

Also in the present embodiment, each of the ink absorbers 82*a* to 82*d* is composed of the inner porous body 83 and the outer porous body 84. The inner porous body 83 has smaller holes than the outer porous body 84.

Accordingly, ink can smoothly absorbed from the nozzles in the respective nozzle rows 4*k*, 4*c*, 4*y* and 4*m* in the recovery process, and thus, performance of the maintenance mechanism 80 is enhanced.

That is, in capillary action, it is known that the smaller the diameter of holes in an absorber is, the higher the absorbency of the absorber is. Therefore, the absorbency of ink from the outer porous body 84 toward the inner porous body 83 is increased. Ink can be smoothly absorbed into the ink absorbers 82*a* to 82*d*.

Additionally, the respective ink absorbers 82*a* to 82*d* are attached to the rotation member 80 separated by the partition wall 81*b*. The different ink absorber 82*a* to 82*d* is used for a different color. Thus, color mixture can be prevented in the recovery process.

Second Embodiment

A second embodiment is explained hereinafter by way of FIGS. 8A to 8B and 9.

Figure 8A:
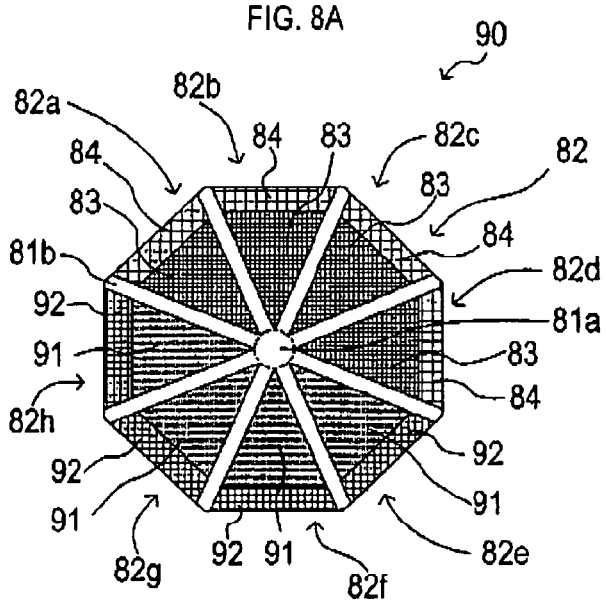
FIGS. 8A and 8B are explanatory views illustrating an internal structure of a maintenance mechanism according to a second embodiment
Figure 8B:
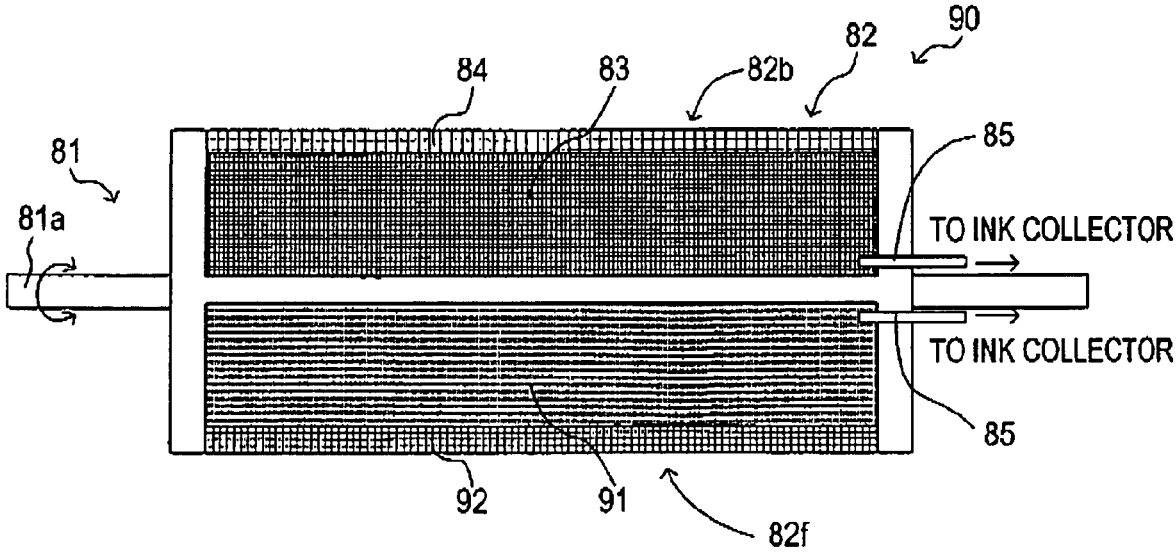

FIGS. 8A and 8B are explanatory views illustrating an internal structure of a maintenance mechanism 90 according to the second embodiment. FIG. 9 is a flowchart illustrating a recovery process executed in the control processor 70 according to the second embodiment. In FIGS. 8A to 8B and 9, the same reference numbers are given to the same components or steps as in the first embodiment, and thus detailed explanation on the same is not repeated.

Figure 9:
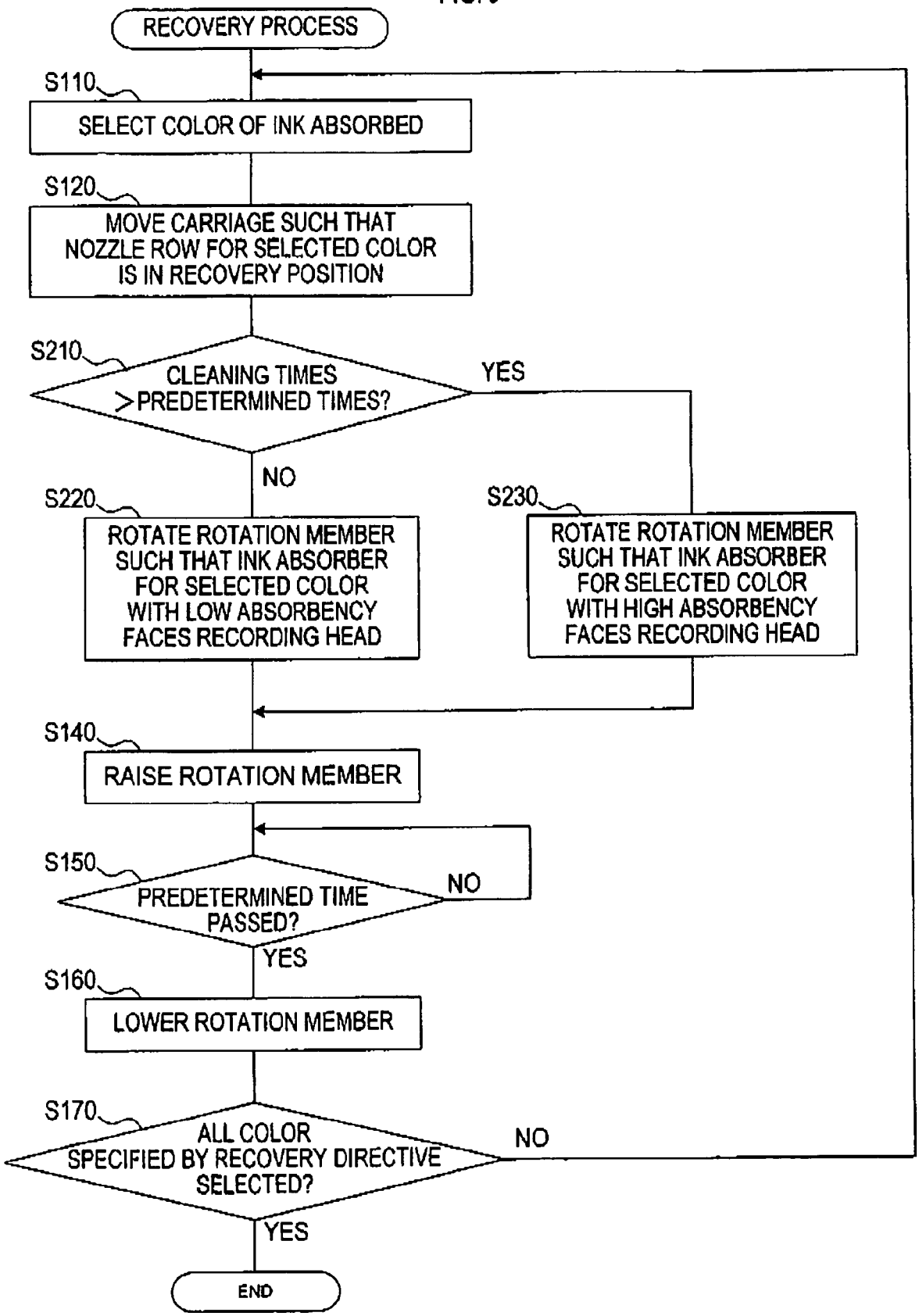
FIG. 9 is a flowchart illustrating a recovery process executed in the control processor according to the second embodiment.

The multi function apparatus 1 in the second embodiment is only different from the multi function apparatus 1 in the first embodiment in that the maintenance mechanism 80 is replaced with the maintenance mechanism 90, and a recovery process in FIG. 9 is performed instead of the recovery process in FIG. 5.

The maintenance mechanism 90 includes the rotation member 81, an ink absorber 82, the rotation motor 86, the lift 87, and the position sensor 88. The ink absorber 82 includes ink absorbers 82*a* to 82*h* which are separately arranged around the rotation shaft 81*a* of the rotation member 81 per 45 degrees by the partition wall 81*b*.

Each of the ink absorbers 82*e* to 82*h* (second ink absorbers), like each of the ink absorbers 82*a* to 82*d* (first ink absorbers), is also composed of two porous bodies, i.e., an inner porous body 91 and an outer porous body 92. The sizes (diameters) of the holes in the respective porous bodies 83, 84, 91 and 92 (hereinafter, referred to as d83, d84, d91 and d92, respectively) are different from each other, By comparison, the inner porous body 91 has the smallest holes, the inner porous body 83 has the smallest holes next after the inner porous body 91, the outer porous body 92 has the largest holes next after the outer porous body 84, and the outer porous body 84 has the largest holes (i.e., d91<d83<d92<d84).

Accordingly, the absorbency of the ink absorbers 82*e* to 82*h* is higher than the absorbency in the ink absorbers 82*a* to 82*d*.

Now, a recovery process performed by the control processor 70 according to the present embodiment is explained by way of FIG. 9.

When the control processor 70 starts the recovery process in FIG. 9 and the steps of S110 and S120 are performed, it is determined in S210 whether the recovery process is repeated more than predetermined times (two times, for example) within a predetermined time.

If it is determined in S210 that the recovery process is not performed more than the predetermined time (S210: NO), the process moves to S220. The rotation motor 86 is driven to rotate the rotation member 81 such that one of the ink absorbers 82*a* to 82*d* with lower absorbency corresponding to the color selected in S110 faces the recording head 4. The process moves to S140.

On the other hand, if it is determined in S210 that the recovery process is performed more than the predetermined time (S210: YES), the process moves to S230. The rotation motor 86 is driven to rotate the rotation member 81 such that one of the ink absorbers 82*e* to 82*h* with higher absorbency corresponding to the color selected in S110 faces the recording head 4. The process moves to S140.

As noted above, in the multi function apparatus 1 according to the second embodiment, when the recovery process is performed more than the predetermined times (two times in the present embodiment) within the predetermined time, the ink absorbers 82*e* to 82*h* with higher absorbency are selected instead of the ink absorbers 82*a* to 82*d* with lower absorbency.

Accordingly, ejection failure of the nozzle which cannot be possibly recovered using the ink absorbers 82*a*to 82*d* with lower absorbency may be recovered using the ink absorbers 82*e* to 82*h* with higher absorbency.

According to the multi function apparatus 1 of the second embodiment, recovery operation can be performed using the ink absorbers with different absorbencies, depending on the degree of ejection failure of the nozzle.

That is, the ink absorbers 82*a* to 82*d* with predetermined ink absorbencies are used in normal recovery operation. Only to the nozzle of which degree of ejection failure is relatively high, the ink absorbers 82*e* to 82*h* with higher absorbencies are used.

Therefore, the amount of ink absorbed from the respective nozzles in the recording head 4 can be reduced in the recovery operation. The multi function apparatus 1 (ink-jet recording apparatus) can use more ink for forming an image onto the recording paper P.

The embodiments of the present invention are described in the above. However, it should be noted that the present invention can be practiced in various manners.

In the above embodiments, the maintenance mechanism 80, 90 is provided in the multi function apparatus 1 including the ink cartridges for four colors of ink. However, the multi function apparatus 1 may include ink cartridges for more than four colors of ink.

Figure 10A:
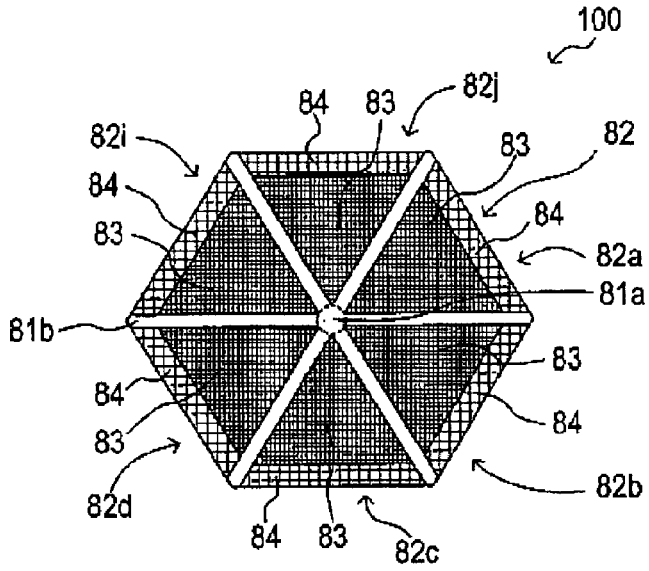
FIGS. 10A and 10B are explanatory views illustrating an internal structure of a maintenance mechanism according to a variation.
Figure 10B:
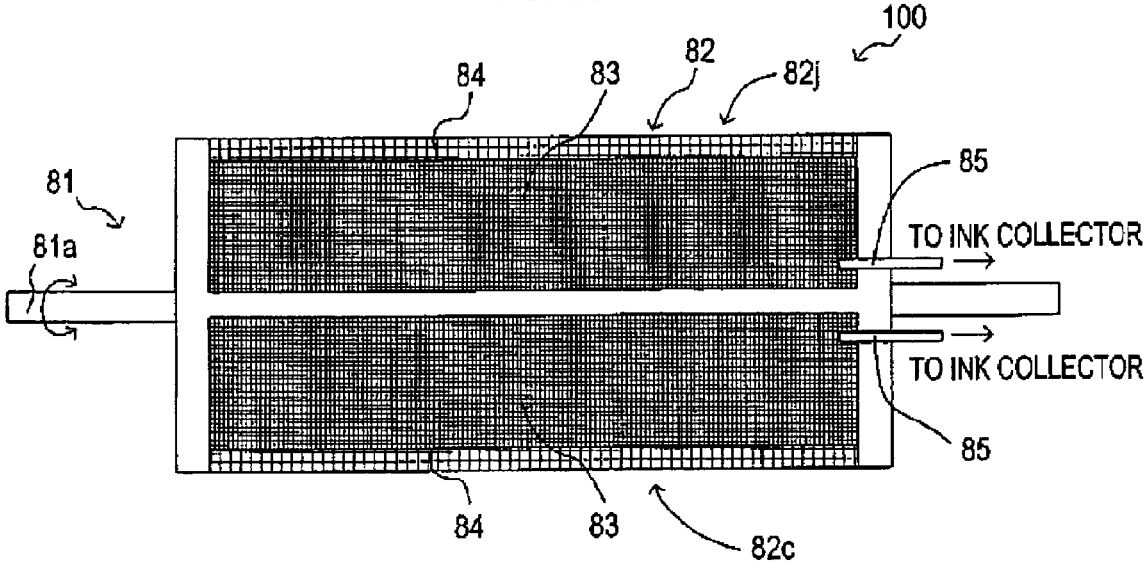

For example, the multi function apparatus 1 may include ink cartridges for six colors (e.g., Bk, C, Y, M, light cyan and light magenta) of ink. In this case, as shown in FIGS. 10A and 10B, six ink absorbers 82*a* to 82*d*, 82*i* and 82*j* may be separately arranged around the rotation shaft 81*a* per 60 degrees by the partition wall 81*b* in a maintenance mechanism 100.

Also in the above embodiments, the LF motor 131 and the rotation motor 86 are used to rotate the feed roller 6*b*, the driving roller 50, the discharge roller 28 and the rotation member 81. However, the feed roller 6*b*, the driving roller 50, the discharge roller 28 and the rotation member 81 may be designed to be rotated only by a single motor.

In the second embodiment, the ink absorbers 82*e* to 82*h* with higher absorbency are selected instead of the ink absorbers 82*a* to 82*d* with lower absorbency when the recovery process is repeated more than the predetermined times within the predetermined time. However, which of the ink absorbers 82*e* to 82*h* or the ink absorbers 82*a* to 82*d* to use may be determined in accordance with directives from the user.

Also in the second embodiment, the sizes of the holes in the respective porous bodies 83, 84, 91 and 92 are different from each other (i.e., d91<d83<d92<d84). However, the sizes of the holes in the respective porous bodies 83, 84, 91 and 92 may be arbitrarily determined. It is preferable that the size of the holes in the respective porous bodies 83, 84, 91 and 92 are smaller than the size of the holes of the nozzles in the recording head 4. It is further preferable that the inner porous bodies 83 and 91 respectively have the smaller holes than the outer porous bodies 84 and 92.

For example, the sizes of the holes in the inner porous bodies 83 and 91 may be the same, and the sizes of the holes in the outer porous bodies 84 and 92 may be the same (i.e., d91=d83<d92=d84). Or, the sizes of the holes of only one of the above pairs may be the same (i.e., d91=d83<d92<d84 or d91<d83<d92=d84).

The lift 87 may be composed of any mechanisms, in the case where the rotation member 81 is raised and lowered such that the ink absorbers 82*a* to 82*d* (and 82*e* to 82*h*) can be brought into contact with the nozzles in the respective nozzle rows 4*k*, 4*c*, 4*y* and 4*m*. For example, the lift 87 may be designed as a mechanism made of a motor and a link.

In the above embodiments, the present invention is applied to the recording head 4 mounted on the carriage 5 which can reciprocate in a predetermined direction, that is, a recording head for a serial printer. However, the present invention can be also applied to a recording head for a line printer in which the recording head is arranged in a fixed position.

Also in the above embodiments, the ink absorbing member 82 absorbs ink using capillary action. However, the ink absorbing member 82 may absorb ink in a different manner (e.g., by suction using negative pressure, wiping, etc.).

Also in the above embodiments, the rotation shaft 81*a* of the rotation member 81 is arranged substantially parallel in the arrangement direction of the plurality of nozzles in the respective nozzle rows 4*k*, 4*c*, 4*y* and 4*m*. However, the rotation shaft 81*a* may be arranged so as not to be parallel to the arrangement direction of the plurality of nozzles.

Also in the above embodiments, the partition wall 81*b* is provided to separate each one of the plurality of ink absorbers 82*a* to 82*d* (82*a* to 82*h*) from the others. However, the partition wall 81*b* may not be provided at all.

For example, the plurality of ink absorbers 82*a* to 82*d* (82*a* to 82*h*) may be composed as a single unit.

In order to effectively prevent different colors of ink from migrating among the surfaces of the plurality of ink absorbers 82*a* to 82*d* (82*a* to 82*h*), it is preferable that each one of the plurality of ink absorbers 82*a* to 82*d* (82*a* to 82*h*) is provided at least partially separated from the others.

In the above embodiments, the color of ink ejected from the nozzles in each of the nozzle rows 4*k*, 4*c*, 4*y* and 4*m* is different from the color of ink ejected from a the nozzles in the other nozzle rows. However, the nozzles in at least two nozzle rows may eject the same color of ink.

What is claimed is:

1. An ink-jet recovery device comprising:

a rotation member adapted to rotate on a predetermined rotation shaft;

an ink absorbing member that is arranged around the rotation shaft of the rotation member and absorbs ink from a tip of a nozzle member of a recording head in an ink-jet recording apparatus when the ink absorbing member is abutted to the nozzle member, the nozzle member ejecting ink toward a recording medium;

a moving unit that brings a part of the ink absorbing member into abutment with the nozzle member; and a rotation unit that rotates the rotation member on the rotation shaft to switch the part of the ink absorbing member to be brought into abutment with the nozzle member by the moving unit;

wherein the ink absorbing member includes plurality of ink absorbers separately arranged around the rotation shaft of the rotation member.

2. The ink-jet recovery device according to claim 1 wherein the ink absorbing member is designed to absorb ink from the tip of the nozzle member by capillary action.

3. The ink-jet recovery device according to claim 2 wherein the ink absorbing member is designed such that its absorbency of ink increases from the part abutted by the nozzle member toward its opposite end.

4. The ink-jet recovery device according to claim 1 wherein the plurality of ink absorbers are separately arranged around the rotation shaft of the rotation member per predetermined angle.

5. The ink-jet recovery device according to claim 1 wherein a partition wall is provided to separate each one of the plurality of ink absorbers from the other ink absorbers.

6. The ink-jet recovery device according to claim 1 wherein the plurality of ink absorbers includes at least one first ink absorber that has a predetermined ink absorbency and at least one second ink absorber that has an ink absorbency higher than the ink absorbency of the first ink absorber.

7. The ink-jet recovery device according to claim 1 wherein the nozzle member includes a plurality of nozzle rows, each of the nozzle rows has a plurality of nozzles, color of ink ejected from the nozzles in each one of the nozzle rows is different from color of ink ejected from the nozzles in at least the other one of the nozzle rows, and the number of the ink absorbers is not less than the number of nozzle rows.

8. The ink-jet recovery device according to claim 1 further comprising:

a rotation control unit that controls the rotation member to rotate the rotation member on the rotation shaft such that one specific ink absorber out of the plurality of ink absorbers is abutted to the nozzle member by the moving unit, wherein the moving unit brings the specific ink absorber into abutment with the nozzle member.

9. The ink-jet recovery device according to claim 1 wherein the nozzle member includes a plurality of nozzle rows, each of the nozzle rows has a plurality of nozzles, color of ink ejected from the nozzles in each one of the nozzle rows is different from color of ink ejected from the nozzles in at least the other one of the nozzle rows, the number of the ink absorbers is not less than the number of nozzle rows, the ink-jet recovery device further comprises:

a rotation control unit that controls the rotation member to rotate the rotation member on the rotation shaft, so as to prevent the same ink absorber from being abutted by the moving member to the nozzle rows, one of which having the nozzles that ejects ink of a specific color and the other of which having nozzles that ejects ink of a color different from the specific color.

10. The ink-jet recovery device according to claim 1 wherein the nozzle member includes a plurality of nozzle rows, each of the nozzle rows has a plurality of nozzles, the ink jet recovery device further comprises:

a facing control unit that brings one specific nozzle row out of the nozzle rows into facing relation to the ink absorbing member; and a rotation control unit that controls the rotation member to rotate the rotation member on the rotation shaft such that one specific ink absorber out of the plurality of ink absorbers is abutted by the moving unit to the specific nozzle row brought into facing relation to the ink absorbing member by the facing control unit, and the moving unit brings the specific ink absorber into abutment with the specific nozzle row.

11. The ink-jet recovery device according to claim 1 wherein the plurality of ink absorbers includes at least one first ink absorber that has a predetermined ink absorbency and at least one second ink absorber that has an ink absorbency that is higher than the ink absorbency of the first ink absorber, the nozzle member includes a plurality of nozzle rows, each of the nozzle rows has a plurality of nozzles, the ink-jet recovery device further comprises:

a facing control unit that brings one specific nozzle row out of the nozzle rows into facing relation to the ink absorbing member;

a determination unit that determines whether the first ink absorber has been abutted by the moving unit to the specific nozzle row brought into facing relation to the ink absorbing member by the facing control unit more than predetermined times within a predetermined time; and a rotation control unit that controls the rotation member to rotate the rotation member on the rotation shaft such that the first ink absorber is abutted to the specific nozzle row, when it is determined by the determination unit that the first ink absorber has not been abutted by the moving unit to the specific nozzle row more than the predetermined times within the predetermined time, and controls the rotation member to rotate the rotation member on the rotation shaft such that the second ink absorber is abutted to the specific nozzle row, when it is determined by the determination unit that the first ink absorber has been abutted by the moving unit to the specific nozzle row more than the predetermined times within the predetermined time, the moving unit brings the first ink absorber into abutment with the specific nozzle row when it is determined by the determination unit that the first ink absorber has not been abutted by the moving unit to the specific nozzle row more than the predetermined times within the predetermined time, and the moving unit brings the second ink absorber into abutment with the specific nozzle row when it is determined by the determination unit that the first ink absorber has been abutted by the moving unit to the specific nozzle row more than the predetermined times within the predetermined time.

12. The ink-jet recovery device according to claim 1 wherein the nozzle member includes a plurality of nozzle rows, each of the nozzle rows has a plurality of nozzles arranged along a predetermined arrangement direction, and the rotation shaft of the rotation member is arranged substantially parallel to the arrangement direction of the plurality of nozzles.

13. The ink-jet recovery device according to claim 1 wherein the ink-jet recovery device is provided in the ink-jet recording apparatus.

14. An ink-jet recovery device comprising:

a rotation member adapted to rotate on a predetermined rotation shaft;

an ink absorbing member that is arranged around the rotation shaft of the rotation member and absorbs ink from a tip of a nozzle member of a recording head in an ink-jet recording apparatus when the ink absorbing member is abutted to the nozzle member, the nozzle member ejecting ink toward a recording medium;

a moving unit that brings a part of the ink absorbing member into abutment with the nozzle member; and a rotation unit that rotates the rotation member on the rotation shaft to switch the part of the ink absorbing member to be brought into abutment with the nozzle member by the moving unit;

wherein the ink absorbing member is designed to absorb ink from the tip of the nozzle member by capillary action; and wherein the ink absorbing member is designed such that its absorbency of ink increases from the part abutted by the nozzle member toward its opposite end on a side of the rotation shaft.

* * * * *